United States Patent [19]

Barakitis et al.

[11] Patent Number: 4,465,954

[45] Date of Patent: Aug. 14, 1984

[54] DISCHARGE LAMP STARTING AND OPERATING CIRCUIT

[75] Inventors: Nikolaos Barakitis, Haverhill; Sheppard Cohen, Danvers, both of Mass.

[73] Assignee: GTE Products Corporation, Stamford, Conn.

[21] Appl. No.: 578,328

[22] Filed: Feb. 13, 1984

Related U.S. Application Data

[63] Continuation of Ser. No. 376,804, May 10, 1982.

[51] Int. Cl.[3] ..... H05B 39/04

[52] U.S. Cl. ..... 315/104; 315/35; 315/73; 315/101; 315/129

[58] Field of Search ..... 315/104, 101, 119, 125, 315/129, 35, 130, 73, 324

[56] References Cited

U.S. PATENT DOCUMENTS

| | | | |
|---|---|---|---|
| 3,694,692 | 9/1972 | Pressman | 315/92 |
| 3,737,720 | 6/1973 | Willis | 315/92 |
| 3,890,534 | 6/1975 | Horowitz | 315/91 |
| 4,117,370 | 9/1978 | Jacobs et al. | 315/35 |
| 4,321,506 | 3/1982 | Tsuchihashi et al. | 315/35 |
| 4,345,186 | 8/1982 | Saito et al. | 315/75 |
| 4,355,261 | 10/1982 | Cohen | 315/290 |
| 4,355,265 | 10/1982 | Cohen | 315/290 |

*Primary Examiner*—Harold Dixon

*Attorney, Agent, or Firm*—Thomas H. Buffton

[57] ABSTRACT

Apparatus for starting and operating a discharge lamp includes a starting device having bimetals and a rigid conductive member forming a switch, a ballast coupling the switch to an AC source and a discharge lamp and a spark gap each shunting the starting device with the starting device bimetals and rigid conductive device hermetically sealed in a vacuum.

10 Claims, 3 Drawing Figures

DISCHARGE LAMP STARTING AND OPERATING CIRCUIT

This application is a continuation of application Ser. No. 376,804, filed May 10, 1982.

TECHNICAL FIELD

This invention relates to discharge lamp starting and operating circuits, and more particularly to an improved circuit for efficiently starting and operating low wattage, high intensity discharge lamps.

BACKGROUND ART

A copending application U.S. Ser. No. 216,876, filed Dec. 15, 1980, now U.S. Pat. No. 4,355,265, describes a lamp starting circuit including an input ballast circuit that typically comprises an inductor, capacitor and resistor, and a circuit shorting switch, referred to therein as a glow-starter device. The circuit shorting switch operates in a controlled gas atmosphere as described in copending application U.S. Ser. No. 216,874, filed Dec. 15, 1980 now U.S. Pat. No. 4,329,621. The shorting switch starter is described therein as having a first terminal connected to a first bimetal, a second terminal connected to a second bimetal, and a third terminal connected to a rigid conductive member, the bimetals being electrically connected together at one end which makes a normally closed contact with the rigid member in the quiescent state of the device; means connecting the second and third terminals of the starter device across the output of the ballast circuit; and means for connecting the first and third terminals of the starter device across the terminals of a discharge lamp. Upon initial energization of the ballast, short circuit current through the second and third terminals of the starter device is operative to flex the second bimetal for separating the bimetals from the rigid member to provide an open circuit thereat and a switching transient across the lamp. Upon occurrence of this open circuit, the lamp is adapted to start. Lamp current flowing through both bimetals maintains the switch open and the lamp lit.

The transient voltage resulting from the opening of the shorting switch is equal to L di/dt. L is the inductance of the reactor; i is the current flowing at the instant the switch opens; and t is the time for the switch to open. If the switching transient voltage is sufficiently high, lamp ignition into the glow state results.

The open circuit steady state voltage (OCV) applied across the lamp immediately after the switching transient is the summation of the line voltage and the voltage across the capacitor of the ballast circuit at the instant the switch opens, or, $OCV = V_c + V$ input. Thus, the open circuit voltage is the input AC voltage displaced from a zero reference by the DC capacitor voltage. Thus, the peak value of the open circuit voltage is the peak of the input voltage in the direction of the capacitor voltage plus the capacitor voltage itself. Because the capacitor voltage wave shape resembles a sine wave with its top flattened, there is a good probability that the voltage across the capacitor is somewhat near its peak after the switch opens. When the capacitor voltage is sufficiently high, the open circuit voltage is large enough to initiate the transition from the glow to the arc state. Simultaneously, the energy stored in the ballast capacitor ($\frac{1}{2}$ $CE^2$) is discharged through the lamp. If there is insufficient energy the arc extinguishes.

Therefore, sufficient energy must be presented to the discharge to ensure arc sustainability.

In the aforementioned copending application U.S. Ser. No. 216,874, the three terminal bimetal starter switch is sealed in a controlled gas atmosphere to control the amplitude of the switching transient voltage. The controlled gas atmosphere may be an argon gas fill. The control of the amplitude of the transient voltage is necessary to ensure that excessively large voltages are not generated which might otherwise cause a component failure. In the aforementioned copending application U.S. Ser. No. 216,876, the circuit described therein with the use of a gas atmosphere enclosing the switch did indeed reduce the maximum transient voltage. However, it was also found that the gas atmosphere switch provided a path in parallel with the discharge lamp through which the capacitor would at least partially discharge. Thus, a significant portion of the capacitor energy, intended to be transmitted to the lamp for glow-to-arc transition, was being dissipated in the gas switch. This resulted in numerous arc extinguishments and overall less reliable starting.

SUMMARY OF THE INVENTION

Accordingly, it is an object of the present invention to provide a new and improved starter device and an improved circuit for starting a high intensity discharge lamp.

A further object of the present invention is to provide an improved means for starting high intensity discharge lamps with improved starting reliability.

Still another object of the present invention is to provide an improved starter device for high intensity discharge lamps by substantially eliminating the problem mentioned hereinbefore relating to the parallel capacitor discharge path by substantially removing the parallel capacitor discharge path. This enables substantially all of the capacitor energy to be transferred to the discharge, facilitating the glow-to-arc transition, thus enhancing the starting reliability.

A further object of the present invention is to provide a new and improved starter device for high intensity discharge lamps and having means for controlling the amplitude of the switching transient voltage so as to alleviate component failure due to excessively high voltages in the circuit.

To accomplish the foregoing and other objects of this invention, the circuit shorting switch is enclosed in a vacuum which, for all practical purposes, removes the parallel capacitor discharge path. This enables almost all of the capacitor energy to be transferred to the discharge, facilitating the glow-to-arc transition and thus providing more reliable starting. However, by providing the vacuum there now remains the problem of controlling the maximum switching transient voltage if the lamp does not light. To overcome this problem, in accordance with the present invention there is provided a spark gap disposed in parallel with the discharge lamp. The arc over voltage of the spark gap is selected to be greater than the breakdown voltage of the discharge lamp to ensure reliable lamp starting. Moreover, the arc over voltage of the spark gap is also selected to be less than a value that could cause damage to the starting circuit.

In accordance with one embodiment of the invention, the starter circuit comprises a ballast circuit having an input connected to a source of AC line voltage and a power output and a starter device having a first terminal connected to a conductor, a second terminal connected to a bimetal, and a third terminal connected to a rigid conductive member with the conductor and bimetal being electrically connected together at one end which makes a normally closed contact with the rigid member in the quiescent state of the device. Means are provided for both connecting the second and third terminals of the starter device across the output of the ballast circuit and for connecting the first and third terminals of the device across the terminals of the discharge lamp. In another aspect of the invention there is also provided a spark gap and means connecting this spark gap across the first and third terminals of the starter device thereby placing the spark gap across the discharge lamp. The starter device has a sealed envelope containing a vacuum to substantially reduce the ballast circuit discharge therethrough. Upon initial energization of the ballast, short circuit current through the second and third terminals of the starter device is operative to flex the bimetal for separating the bimetal from the rigid member to provide an open circuit thereat and a switching transient across the lamp. The arc over voltage of the spark gap is selected so that it is greater than the breakdown voltage of the discharge lamp to ensure reliable lamp starting. Furthermore, the arc over voltage of the spark gap is selected so that it has a value less than a value that would be expected to cause damage to components of the circuit.

BRIEF DESCRIPTION OF THE DRAWINGS

Numerous other objects, features and advantages of the invention should now become apparent upon a reading of the following detailed description taken in conjunction with the accompanying drawings in which.

BEST MODE FOR CARRYING OUT THE INVENTION

Figure 1:
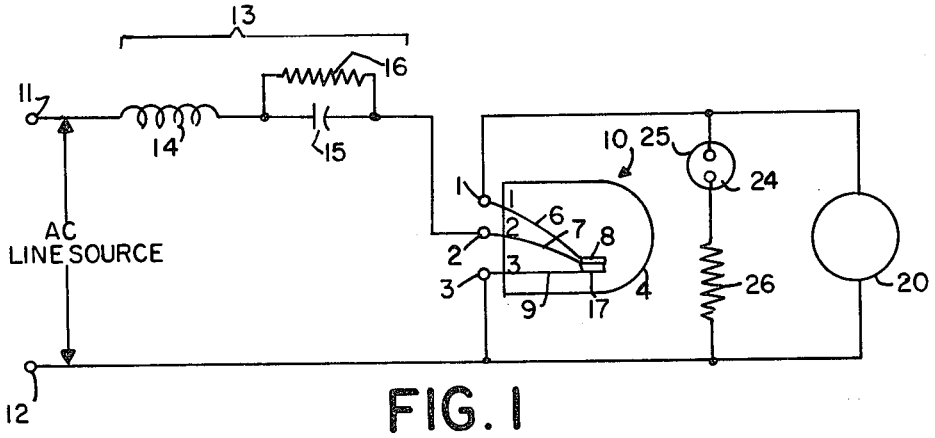
FIG. 1 is a circuit diagram of an improved starting and operating circuit embodiment of the present invention.

Referring to FIG. 1, there is shown a circuit diagram illustrating an embodiment of the present invention comprising a ballast and associated starting system for igniting, facilitating transition from glow-to-arc, and operating a high intensity discharge lamp 20. The lamp 20 may be a low wattage metal halide arc discharge lamp. The circuit shown in FIG. 1 includes a lead circuit ballast 13 in combination with a shorting-starting switch 10. The input terminals 11 and 12 of the circuit are connected to an AC line source, e.g., 120 volts/60 hertz. The lead circuit ballast 13 is comprised of an inductive reactor 14 such as a choke coil, and a capacitor 15 series connected in that order between the AC input terminal 11 and terminal 2 of the starter device 10. A discharge resistor 16 is connected across capacitor 15. The AC input terminal 12 is connected to terminal 3 of the starter device 10, and terminals 1 and 3 of the starter device 10 are connected across the terminals of the discharge lamp 20.

The starter device 10 may be of the type described in copending application U.S. Ser. No. 216,874, filed Dec. 16, 1980 and assigned to the present assignee. As illustrated in FIG. 1, the starter device 10 may comprise two bimetals 6 and 7, and a rigid conductive member 9 disposed within a hermetically sealed envelope 4 which in accordance with the present invention has a vacuum atmosphere therein rather than the controlled gas atmosphere described in the aforementioned copending application Ser. No. 216,874. Moreover, one of the bimetals 6 may be replaced by an electrical conductor. Three lead-in wires respectively connected both mechanically and electrically to the bimetals 6 and 7 and rigid conductive member 9 extend through a re-entrant stem sealed at the bottom of the lamp envelope 4, not shown in FIG. 1 but shown and discussed in more detail with regard to the embodiment of FIG. 2. The terminal 1 as shown in FIG. 1 is connected to bimetal 6; the terminal 2 is connected to bimetal 7; and the terminal 3 is connected to the conductive member 9. The two bimetals 6 and 7 are electrically connected together at one end and attached to a contact button 8, such as by welding. A mating contact button 17 is welded to the end of the rigid conductive member 9. In the quiescent state of the device, the bimetals 6 and 7 resiliently urge button 8 to make a normally closed contact with the button 17 of the rigid conductive member 9. Hence, at normal temperature and in the absence of current flowing through either of the bimetals 6 and 7, starter device 10 provides a normally closed switch across both the lamp 20 and the output of the ballast circuit, represented by the AC input and lead circuit 13.

To essentially compensate for the use in accordance with the present invention of a vacuum atmosphere within the starter device 10, there is provided, for controlling transient voltages, the spark gap 24 and resistor 26. The spark gap 24 has its own sealed envelope 25. The spark gap 24 and resistor 26 are connected in series, and the series combination of spark gap 24 and resistor 26 is connected in parallel across both the discharge lamp 20 and terminals 1 and 3 of the starter switch 10. The spark gap 24 is particularly selected in accordance with the present invention to have an arc over voltage greater than the break down voltage of the discharge lamp 20 with which it is used. Moreover, the arc-over voltage of the spark gap 24 is also selected so that it is less than a value that would be expected to cause damaging transient voltages that could destroy components of the system. The resistor 26 in series with the spark gap 24 is selected at a value that will provide sufficient current limiting so that the current through the spark gap 24 is limited to a value which will ensure long spark gap life.

Referring now to the operation of the circuit of FIG. 1, upon initial energization of the circuit with AC input power, ballast short circuit current is drawn through starter terminal 2, bimetal 7, rigid conductive member 9, and starter terminal 3. The resulting $I^2R$ in the bimetal 7 is sufficient to cause the necessary heat to flex both of the bimetals 6 and 7 so as to separate and open the contacts 8 and 17. When this open circuit occurs at the starter 10, the current drawn from the lamp ballast 13 rapidly decreases and the inductive output of the ballast generates a high voltage pulse, thereby producing a switching transient across the lamp 20 which provides sufficient energy to initiate discharge in the lamp 20. Previously, when a controlled gas atmosphere was used in the starter 10, upon generation of the high voltage pulse, at least a portion of the capacitor discharge went through the starter device. However, by providing a vacuum atmosphere within the starter device 10, substantially all of the discharge voltage is coupled to the lamp 20. When the lamp 20 is ignited, current is drawn through both of the bimetals 6 and 7, and the $I^2R$ power is sufficient to maintain the bimetals 6 and 7 separated from the rigid member 9 and thereby keep the contacts 8 and 17 open.

As mentioned previously, the use of vacuum within the starter device 10 solves the capacitor discharge problem at open circuit. However, this would make the circuit susceptible to excessive switching transient voltage when the lamp does not light. Accordingly, in accordance with the invention there is provided the spark gap 24 and associated resistor 26 with the aforementioned arc over voltage of the spark gap for proper operation.

Figure 2:
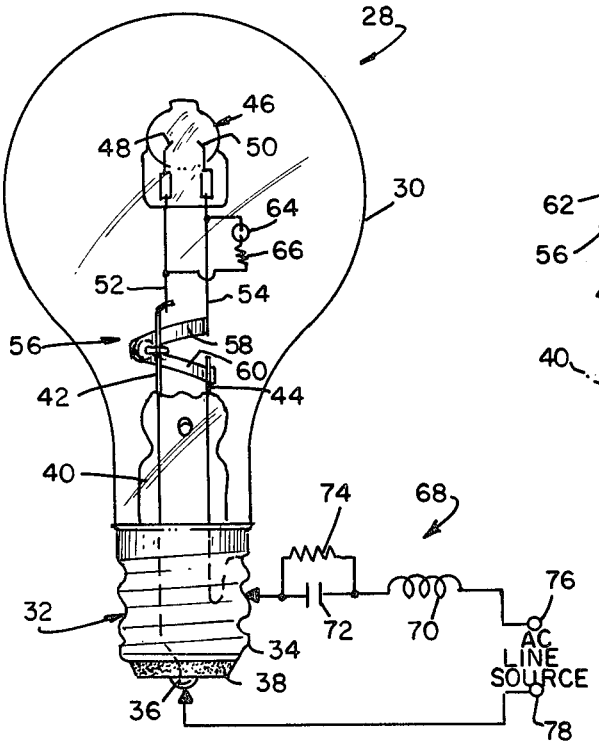
FIG. 2 is a circuit diagram of an alternative embodiment of the invention in which the spark gap and starter device are directly disposed within the same envelope.

Alternatively, FIG. 2 illustrates a discharge lamp starting and operating apparatus which includes a discharge lamp 28 having an outer bulbous envelope 30 with a conventional screw-in base 32. The screw-in base 32 has a shell 34 and a center contact 36 separated from the shell 34 by an insulating material 38. A glass stem mount 40 extends inside the envelope 30 and includes a pair of support wires 42 and 44 sealed therein. Moreover, the glass stem mount 40 is hermetically sealed at one end to the envelope 30. The support wires 42 and 44 are electrically connected to the center contact 36 and the shell 34 respectively.

Disposed within the glass outer envelope 30 is an arc tube 46 enclosing a pair of spaced electrodes 48 and 50 which are electrically connected to a pair of lead wires 52 and 54. The arc tube lead wire 52 is affixed to the support wire 42 while the support wire 44 is electrically connected to a starter device 56. In one specific embodiment, the arc tube 46 is filled with an inert gas at a predetermined pressure, along with quantities of mercury and one or more selected iodides and metal.

Figure 3:
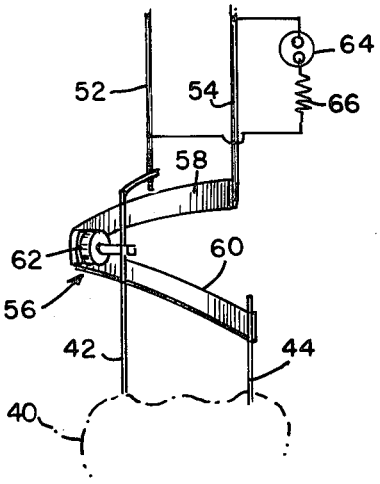
FIG. 3 is a fragmentary view of the starter device of FIG. 2.

Referring more specifically to the discharge lamp 28, reference is made to the enlarged fragmentary view of FIG. 3. Therein, the starter device 56 includes first and second bimetals 58 and 60 and a rigid conductive member 62. The first bimetal 58 is electrically and mechanically connected to the lead wire 54. The second bimetal 60 is electrically and mechanically connected to the support wire 44. Also, the rigid conductive member 62 is electrically and mechanically connected to the support wire 42. Moreover, the two bimetals 58 and 60 are preferably in the form of flexible strips and are connected together at one end and contact the rigid conductor member 62 to provide a normally closed switch. Moreover, a spark gap 64 and a resistor 66 are connected in series and shunted across the lead wire 52 and 54.

As previously described, the envelope 30 is a vacuum sealed container with the starter device 56 and the spark gap 64 sealed therein. However, it should be noted that the starter device 56 as well as the spark gap 64 each may have a separate sealed envelope with a given atmosphere therein. Moreover, the spark gap 64 as well as the starter device 56 may include separate sealed envelopes which are positioned outside the envelope 30.

Additionally, the embodiment of FIG. 2 may include circuitry substantially similar to the apparatus of FIG. 1. Herein, a ballast 68 which includes a series connected choke 70 and capacitor 72 shunted by a resistor 74 couples the support wire 44 by way of the screw-in base 32 to a terminal 76 of an AC potential source (not shown). Also, the other terminal 78 of the AC potential source is coupled to the center contact 36 and to the support wire 42.

As can readily be seen, the electrical connections are essentially similar to the embodiment of FIG. 1. In other words, the ballast 68 is connected to the second bimetal 60, the discharge lamp 46 is coupled across the first bimetal 58 and the rigid conductor member 56, and the series connected spark gap 64 and resistor 66 are coupled across the lead wires 52 and 54 of the discharge lamp 46. Thus, energization causes flexure of the bimetal 60 to cause the bimetals 58 and 60 to disengage from the rigid conductive member 62 and application of an energizing potential from the ballast 68 to the discharge lamp 46 whereby starting thereof is effected.

While there has been shown and described what is at present considered the preferred embodiments of the invention, it will be obvious to those skilled in the art that various changes and modifications may be made therein without departing from the invention as defined by the appended claims.

We claim:

1. A high intensity discharge lamp comprising a first hermetically sealed envelope having a vacuum and a pair of support wires sealed into and extending therethrough;

a hermetically sealed arc tube disposed within said first envelope and having a pair of electrical leads sealed therein and extending therethrough with one of said pair of electrical leads of said arc tube connected to one of said pair of support wires of said first sealed envelope;

a starter device sealed in a vacuum and including a normally-closed (N/C switch coupled across said pair of support wires of said first sealed envelope and having first and second contacts with said first contact coupled by at least one bimetal and an electrical conductor to one of said pair of support wires and one of said pair of electrical leads and said second contact coupled to said support wire connected to said electrical lead; and a spark gap means shunting said pair of electrical leads of said arc tube and having an arc over voltage greater than the breakdown voltage of said arc tube.

2. The high intensity discharge lamp of claim 1 wherein said spark gap means includes a series-connected spark gap and resistor.

3. The high intensity discharge lamp of claim 1 wherein said starter device is disposed within said vacuum of said first hermetically sealed envelope.

4. The high intensity discharge lamp of claim 1 wherein said spark gap means is located within said first hermetically sealed envelope.

5. The high intensity discharge lamp of claim 1 wherein said spark gap means includes a spark gap enclosed within a second hermetically sealed envelope positioned within said first hermetically sealed envelope.

6. The high intensity discharge lamp of claim 1 wherein said first contact is coupled by a first bimetal to one of said pair of support wires and by a second bimetal to one of said pair of electrical leads and a second contact is coupled to said support wire connected to said electrical lead.

7. Apparatus for starting and operating a high intensity discharge lamp having hermetically sealed and evacuated outer envelope comprising:

a pair of terminals formed for connection to an AC line source;

a lead circuit ballast coupled to one of said pair of terminals;

a starter device sealed in a vacuum and having a normally-closed (N/C) switch shunting said discharge lamp, said switch having a first contact coupled by a first bimetal and an electrical conductor to said lead ballast and to said discharge lamp and a second contact coupled to the other one of said pairs of terminals and to said discharge lamp; and a spark gap means connected in shunt with and having an arc-over voltage greater than the breakdown voltage of said discharge lamp.

8. The apparatus of claim 7 wherein said spark gap means includes a series connected spark gap and resistor.

9. The apparatus of claim 7 wherein said spark gap means has an arc-over voltage greater than the breakdown voltage of said discharge lamp and less than an apparatus damage voltage.

10. The apparatus of claim 7 wherein said starter device is contained within said hermetically sealed and evacuated outer envelope of said high intensity discharge lamp.

* * * * *